US008668132B2

(12) United States Patent
Lopez Masague

(10) Patent No.: US 8,668,132 B2
(45) Date of Patent: Mar. 11, 2014

(54) STORAGE BOX

(75) Inventor: Manuel Lopez Masague, Arenys de Mar (ES)

(73) Assignee: Embalajes Capsa, S.L., Canet de Mar (ES)

( * ) Notice: Subject to any disclaimer, the term of this patent is extended or adjusted under 35 U.S.C. 154(b) by 390 days.

(21) Appl. No.: 12/600,076

(22) PCT Filed: May 14, 2008

(86) PCT No.: PCT/IB2008/051898

§ 371 (c)(1),
(2), (4) Date: Nov. 13, 2009

(87) PCT Pub. No.: WO2008/139420

PCT Pub. Date: Nov. 20, 2008

(65) Prior Publication Data

US 2011/0036904 A1 Feb. 17, 2011

(30) Foreign Application Priority Data

May 14, 2007 (ES) ..... 200701359

(51) Int. Cl.
*B65D 5/36* (2006.01)
*B65D 5/68* (2006.01)

(52) U.S. Cl.
USPC ..... 229/117; 229/122; 229/145; 229/155; 229/158

(58) Field of Classification Search
USPC ..... 229/117, 122, 125.19, 145, 155, 158, 229/185.1, 198.2
See application file for complete search history.

(56) References Cited

U.S. PATENT DOCUMENTS 2,060,240 A * 11/1936 Pergande ..... 229/155
2,308,050 A * 1/1943 Burr ..... 229/939
2,319,924 A * 5/1943 Ferguson ..... 229/125.19
2,513,079 A 6/1950 Byerger
3,201,026 A * 8/1965 Travis et al. ..... 229/155

(Continued)

FOREIGN PATENT DOCUMENTS

EP 279754 A2 * 8/1988 ..... 229/122
EP 2161203 1/2013

(Continued)

OTHER PUBLICATIONS

International Search Report for PCT/IB2008/051898, completed Oct. 10, 2008.

(Continued)

*Primary Examiner* — Gary Elkins
(74) *Attorney, Agent, or Firm* — Lawrence G. Fridman

(57) ABSTRACT

The storage box is formed from a sheet provided with a plurality of folding lines defining a parallelepiped provided with six faces, one of said face being a hinged lid (2), and it is characterized in that the opposed face to said hinged lid comprises a first sector (1*a*) provided with an oblique folding line (7*a*) that defines a first joining zone (8*a*); a second sector (1*b*) also provided with an oblique folding line (7*b*) that is joined to said first sector (1*a*) in said first joining zone (8*a*); a third sector (1*c*) provided with an oblique folding line (7*c*) that defines a second joining zone (8*c*); and a fourth sector (1*d*) that is joined to said third sector (1*c*) in said second joining zone (8*c*).
It permits to obtain a box that can be mounted by itself.

16 Claims, 7 Drawing Sheets

(56) References Cited

U.S. PATENT DOCUMENTS

| | | | | | |
|---|---|---|---|---|---|
| 3,240,418 | A | * | 3/1966 | Elias | 229/918 |
| 4,013,213 | A | | 3/1977 | Giebel | |
| 4,027,818 | A | * | 6/1977 | Stoll | 229/158 |
| 4,289,268 | A | * | 9/1981 | Paige | 229/117 |
| 4,373,660 | A | * | 2/1983 | Wytko | 229/185.1 |
| 4,709,852 | A | * | 12/1987 | Stoll | 229/915 |
| 5,390,847 | A | | 2/1995 | Young | |
| 5,927,593 | A | * | 7/1999 | Berkowitz et al. | 229/117 |
| 6,926,192 | B1 | * | 8/2005 | Dowd | 229/117 |
| 2005/0011938 | A1 | | 1/2005 | West | |

FOREIGN PATENT DOCUMENTS

| | | | |
|---|---|---|---|
| FR | 2573038 | A1 * | 5/1986 |
| FR | 2604422 | A | 4/1988 |
| FR | 2781773 | A | 2/2000 |
| FR | 2785870 | A | 5/2000 |
| GB | 700741 | | 12/1953 |

OTHER PUBLICATIONS

EPO Brief Communication Application No./Patent No. 08751194.5-1253/2161203.

* cited by examiner

STORAGE BOX

CROSS REFERENCE TO RELATED APPLICATIONS

This application is the U.S. national phase of PCT/IB2008/051898 filed May 14, 2008 filed PTC/IB2008/051898 claims benefit under the Paris Convention to ES P-200701359 filed May 14, 2007. The disclosures of both of ES P-200701359 and PCT/IB2008/051898 are hereby incorporated herein by reference.

The present invention refers to a storage box that is provided with a lid.

BACKGROUND OF THE INVENTION

Storage boxes that are used for storing files, or for storing other objects are already known. These boxes are usually made from cardboard and comprise a hinged lid.

These storage boxes already known are usually formed from a sheet provided with a number of folding lines, so that by a mounting process the box is obtained and it is ready for its use.

The main problem of these already known boxes is that the sheet that is provided to the user unfolded takes up a substantial space, so it is uncomfortable to mount them.

Furthermore, these boxes usually have also a resistance problem, mainly when they are stacked to each other.

Another drawback that some of these boxes present is that it is necessary to use an external closing element to close the lid, such as e.g. adhesive tape.

DESCRIPTION OF THE INVENTION

With the storage box of the invention said drawbacks can be solved, presenting other advantages that will be described.

The storage box of the present invention is formed from a sheet provided with a plurality of folding lines defining a parallelepiped provided with six faces, one of said face being a hinged lid, characterised in that the opposed face to said hinged lid comprises:

- a first sector provided with an oblique folding line that defines a first joining zone;
- a second sector also provided with an oblique folding line that is joined to said first sector in said first joining zone;
- a third sector provided with an oblique folding line that defines a second joining zone; and
- a fourth sector that is joined to said third sector in said second joining zone.

Thanks to this feature, the storage box of the present invention, that is provided with a lid, can be mounted by itself, i.e. it is provided to the user with said sectors defining the rear face joined to each other as stated previously, so that the box can be provided to the user in its folding position occupying a reduced space, and the user can mount the box easily and quickly.

According to a preferred embodiment, said first sector has a trapezoidal shape, said oblique folding line defining two triangular zones, said second sector has a substantially rectangular shape, said oblique folding line defining a triangular zone and a trapezoidal zone, said third sector has a trapezoidal shape, said oblique folding line defining two triangular zones, and said fourth sector has a trapezoidal shape.

To obtain a more resistant box, two or three of its faces comprise preferably reinforcing sectors that are folded on the respective side faces. Furthermore, the reinforcing sectors comprise flaps that in the mounting position of the box are in contact with the face opposed to the lid.

According to a first embodiment, to close the box, said front face comprises a closing flap that is housed inside a complementary groove provided at an additional flap of the upper face.

Preferably, said closing flap comprises a folding line that divides said closing flap into two.

One of said halves of the closing flap comprises a protrusion that is housed inside an additional groove provided in said additional flap.

Said upper face also comprises a joining flap that, in the mounting position of the box, is joined to the upper part of the adjacent face.

To stack the boxes of the present invention one on the other, the boxes comprise protrusions at their upper part, that are housed inside complementary recesses of the upper box when they are stacked one on the other.

The storage box is made preferably from corrugated cardboard, the channels of the corrugated cardboard being placed in a vertical direction with respect to its use position. Therefore, it is obtained a greater resistance of the box to the compression, particularly when they are stacked one on the other.

According to a second embodiment, the lid is formed by two hinged sectors engageable to each other.

Advantageously, said hinged sectors engageable to each other comprise complementary flaps.

According to a third embodiment, the storage box of the present invention comprises reinforcing flaps around the lid.

BRIEF DESCRIPTION OF THE DRAWINGS

For a better understanding of what has been disclosed some drawings are attached in which, diagrammatically and only as a non-limitative example, a practical case of embodiment is shown.

DESCRIPTION OF PREFERRED EMBODIMENTS

Figure 1:
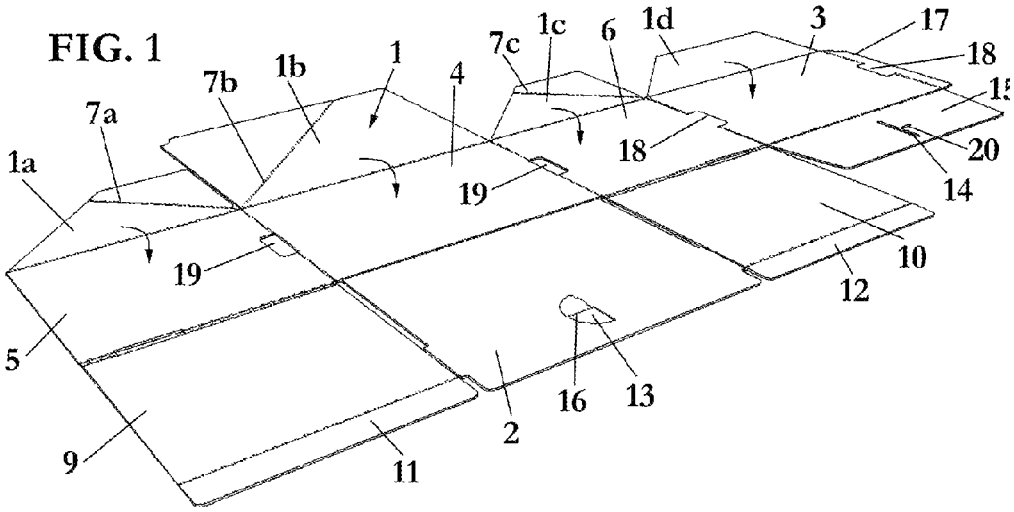
FIG. 1 is a perspective view of the sheet of the storage box of the present invention completely unfolded, according to a first embodiment.

As it can be seen from FIGS. 1-10, the storage box of the present invention is made from a sheet, preferably a corrugated cardboard, provided with a number of folding lines.

Said folding lines define a parallelepiped provided with a rear face 1, a front face 2, an upper face 3, a lower face 4 and two side faces 5, 6, such as it will be described hereinafter.

Firstly, it must be pointed out that the definition of said face is carried out according to the position they occupy during the normal use of the storage box, such as it is shown in the drawings. However, it is apparent that if a user rotates the box, the definition of said faces could change and, e.g. the rear face could be the lower face, as it happens in the second and third embodiments that will be described later.

The rear face, indicated generally by numeral reference 1, comprises:

- a first sector 1*a* provided with an oblique folding line 7*a* defining a first joining zone 8*a;*
- a second sector 1*b* also provided with an oblique folding line 7*b* that it is joined to said first sector 1*a* in said first joining zone 8*a;*
- a third sector 1*c* provided with an oblique folding line 7*c* defining a second joining zone 8*c;* and
- a fourth sector 1*d* that is joined to said third sector 1*c* in said second joining zone 8*c*.

Figure 2:
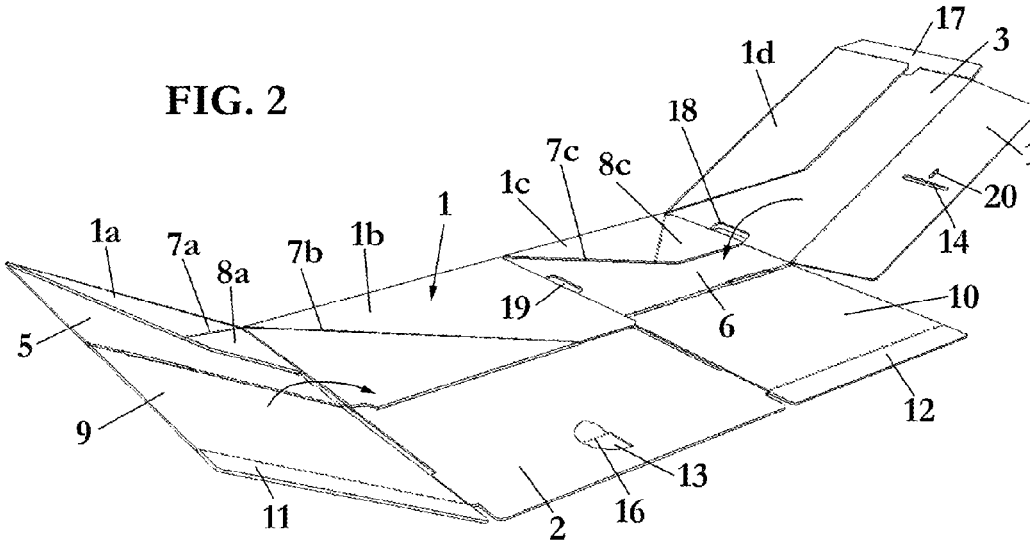
FIGS. 2-9 are perspective view of the sheet of the storage box of the present invention during the mounting process of the box, according to a first embodiment.

It must be pointed out that said sectors are not joined in FIGS. 1 and 2, wherein the sheet is shown in a preliminary phase before the delivery to the user to mount and use it. These two figures are of the manufacturing step of the box, as it will be explained hereinafter.

According to the embodiment shown, said first sector 1*a* has trapezoidal shape, said oblique folding line 7*a* defining two triangular zones, said second sector 1*b* has a substantially rectangular shape, said oblique folding line 7*b* defining a triangular zone and a trapezoidal zone, said third sector 1*c* has a trapezoidal shape, said oblique folding line 7*c* two triangular zones, and said fourth sector 1*d* has trapezoid shape.

Furthermore, said side faces 5, 6 comprise corresponding reinforcement sectors 9, 10, that fold on the respective side faces 5, 6, such as it will be described later during the description of the mounting process of the box of the present invention.

These reinforcing sectors 9, 10 comprise corresponding flaps 11, 12 that in the mounting position of the box are in contact with the rear face 1.

The front face 2 of the box of the present invention is a hinged lid, and said front face 2 comprises a closing flap 13 that is housed inside a complementary groove 14 provided at an additional flap 15 of the upper face 3.

Said closing flap 13 comprises a folding line 16 that divides said closing flap 13 into two.

Said upper face 3 comprises a joining flap 17 that, in the mounting position of the box, is joined to the upper part of the adjacent side face 5.

To permit said boxes to be stacked, said side faces 5, 6 comprise protrusions 18 at their upper part, that are housed into complementary recesses 19 of the upper box when they are stacked one on the other. As it can be seen in the figures, the protrusion 18 of one of said side faces 5 is placed in said joining flap 17.

Firstly, during the manufacturing step, when the sheet is completely unfolded (FIG. 1), the sectors 1*a*, 1*b*, 1*c*, 1*d* are folded on the side 5, lower 4, side 6 and upper faces, respectively, as it can be seen by the arrows represented in FIG. 1.

Then, the assembly of the side face 5 and the reinforcing sector 9 is folded on the rest of the sheet, and the upper face 3 is also folded on the rest of the sheet, as it can be seen by the arrows shown in FIG. 2.

During this folding is when the joining of the joining zones 8*a* and 8*c* on the respective sectors is carried out, and also the joining of the joining flap 17 with the side face 5. Said first and second joining zones 8*a*, 8*c* in the mounted position of the box are placed close to the opposed corners of said rear face.

Figure 3:
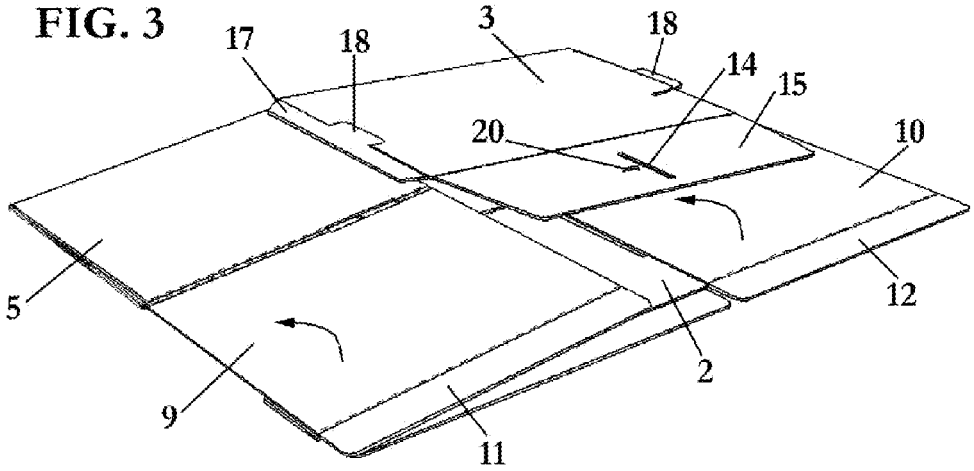
Figure 4:
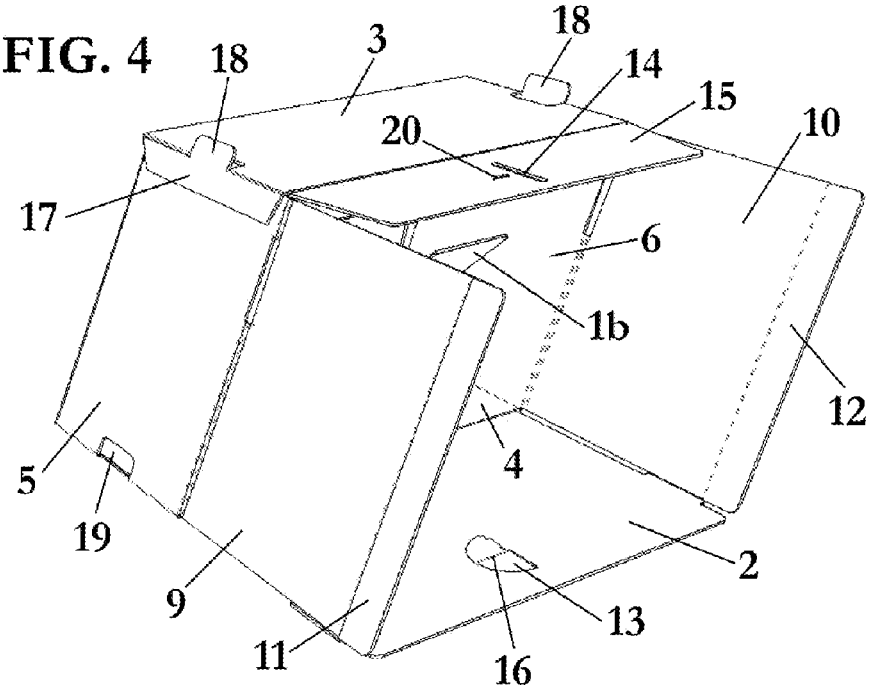

The box of the present invention is provided to the user in the folded position shown in FIG. 3. As it can be seen, the volume that the box occupies in the folded position is reduced, and its mounting is carried out in a quick and comfortable way, as it will be described hereinafter.

Firstly, to mount the box of the present invention it is necessary to rotate the side face 5 and 6 in the direction of the arrows shown in FIG. 3.

The sectors of the rear face 1 are also folded, and they are placed one on the others, the second sector 1*b* being placed at the internal par of said rear face 1.

Figure 5:
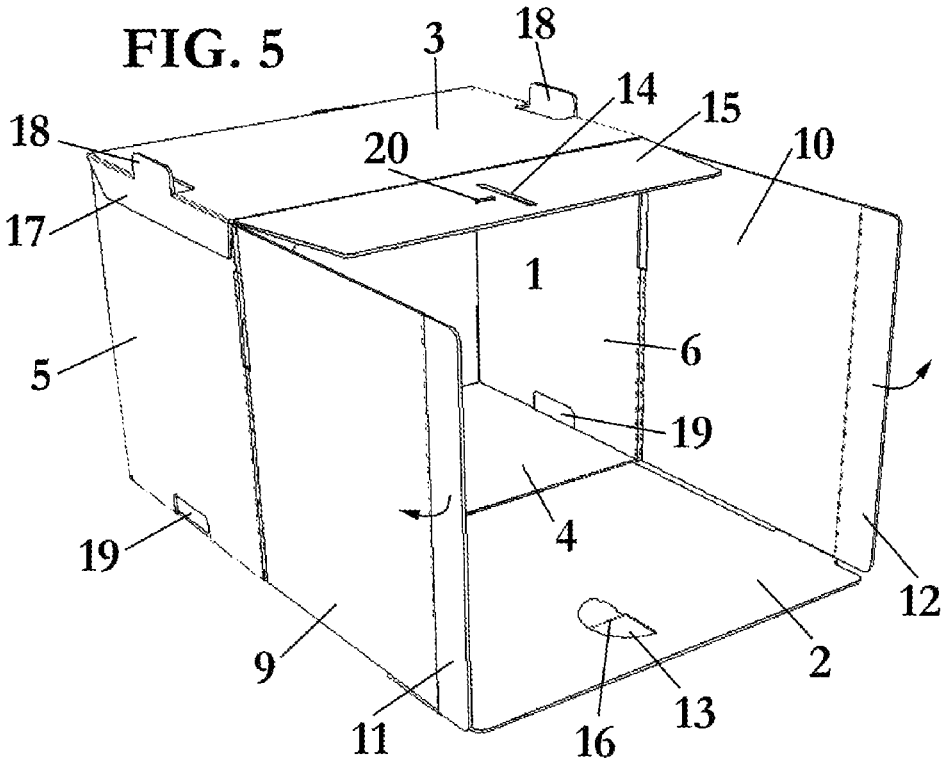
Figure 6:
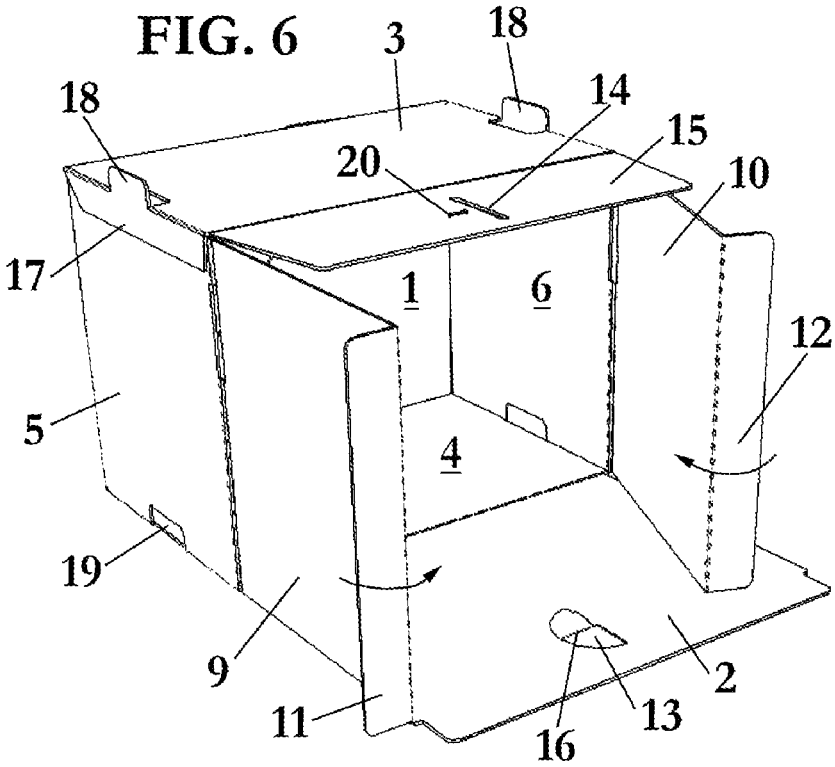

Once in this position, shown in FIG. 5, the flaps 11 and 12 of the reinforcing sectors 9 and 10 are folded outwardly (FIG. 6), and then the reinforcing sectors and 10 are folded inwardly (FIG. 7), so that the reinforcing sectors 9 and 10 are placed on the side faces 5 and 6, respectively, and the flaps 11 and 12 are placed on the rear face 1.

Figure 7:
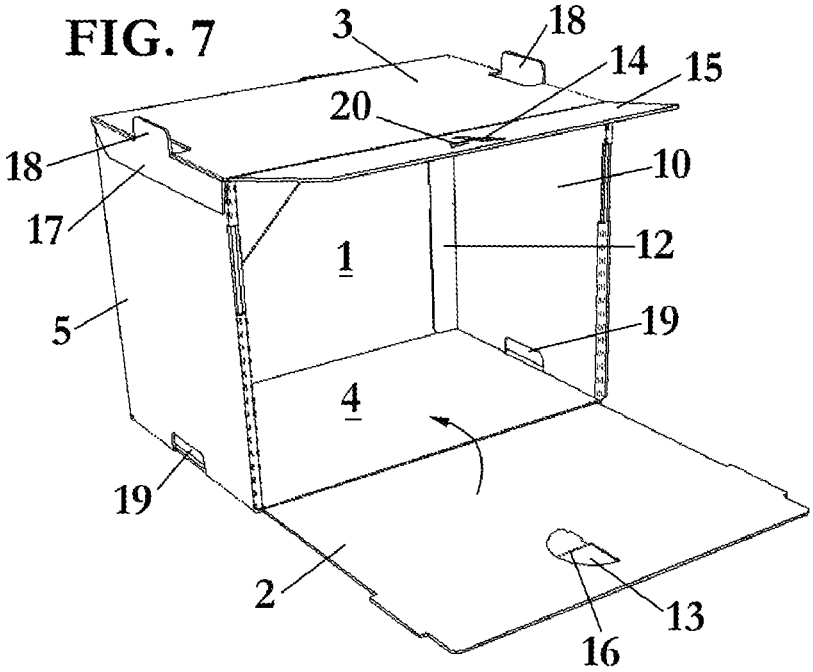
Figure 8:
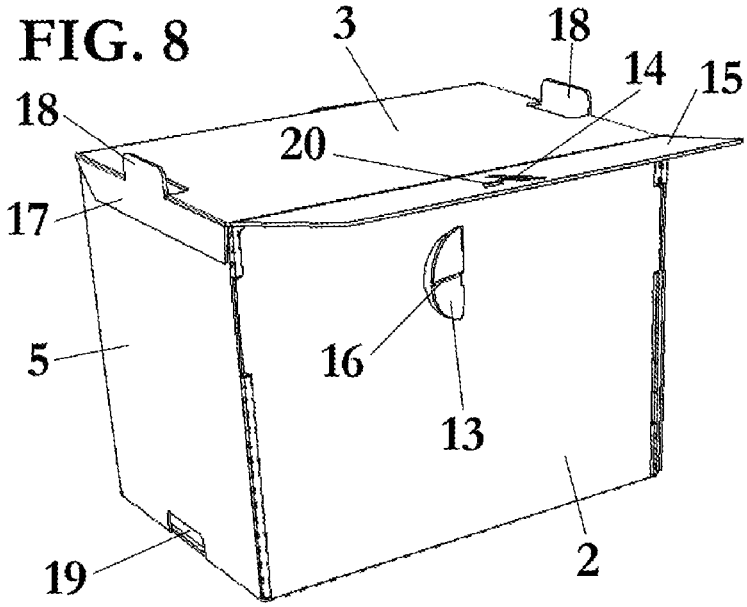
Figure 9:
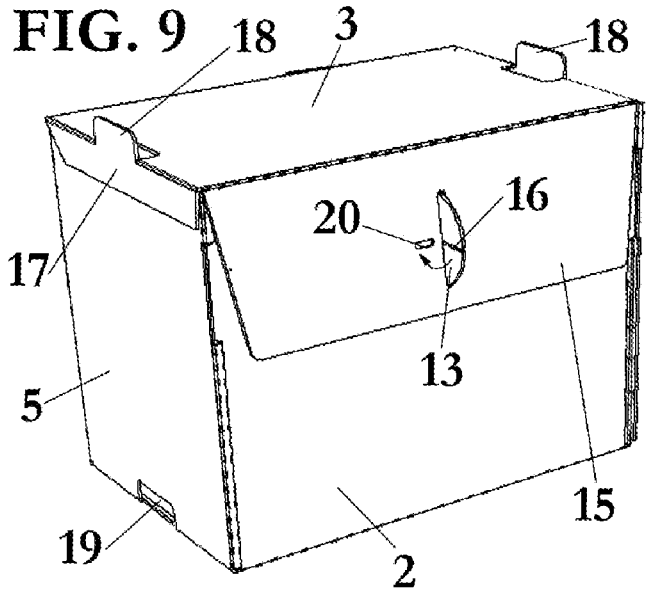
Figure 10:
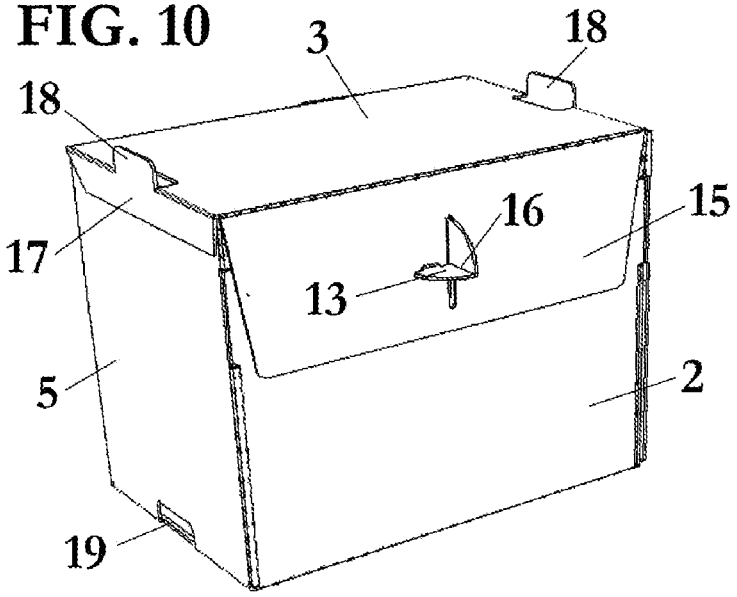
FIG. 10 is a perspective view of the storage box of the present invention in its mounted position, according to said first embodiment.

In this position, shown in FIG. 7, the corresponding files can be placed inside the box, and to close the lid or front face 2 it is rotated 90° towards the box, as it can be seen in FIG. 8.

Then, the additional flap 15 is folded on the front face 2, as it can be seen by the arrow shown in FIG. 8. Furthermore, the closing flap 13 is also folded, being substantially perpendicular with respect to the front face 2.

In this position, the closing flap 13 is housed inside the groove 14 provided at the additional flap 15, and the closing flap 13 is folded about its folding line 16, so that the lower half is folded upwardly (arrow shown in FIG. 9), a protrusion provided at said half being housed into an additional groove 20 also provided at said additional flap 15. Therefore, it is obtained a suitable closing element of the box of the present invention.

To enhance the resistance of the box, it is made preferably from corrugated cardboard, the own channel of the corrugated cardboard being placed in a vertical direction in the side faces.

Hereinafter two additional embodiments of the storage box of the present invention are described. For simplicity reasons the common elements are not described again, and similar reference numbers identify these common elements, specifically the reference numbers of the second embodiment are increased by 100 and by 200 the reference numbers in the third embodiment.

Figure 11:
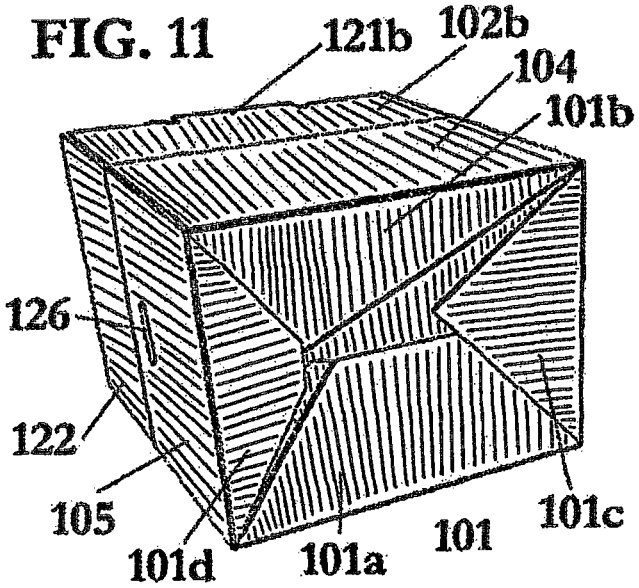
FIG. 11 is a bottom perspective view of the storage box of the present invention, according to a second embodiment.
Figure 12:
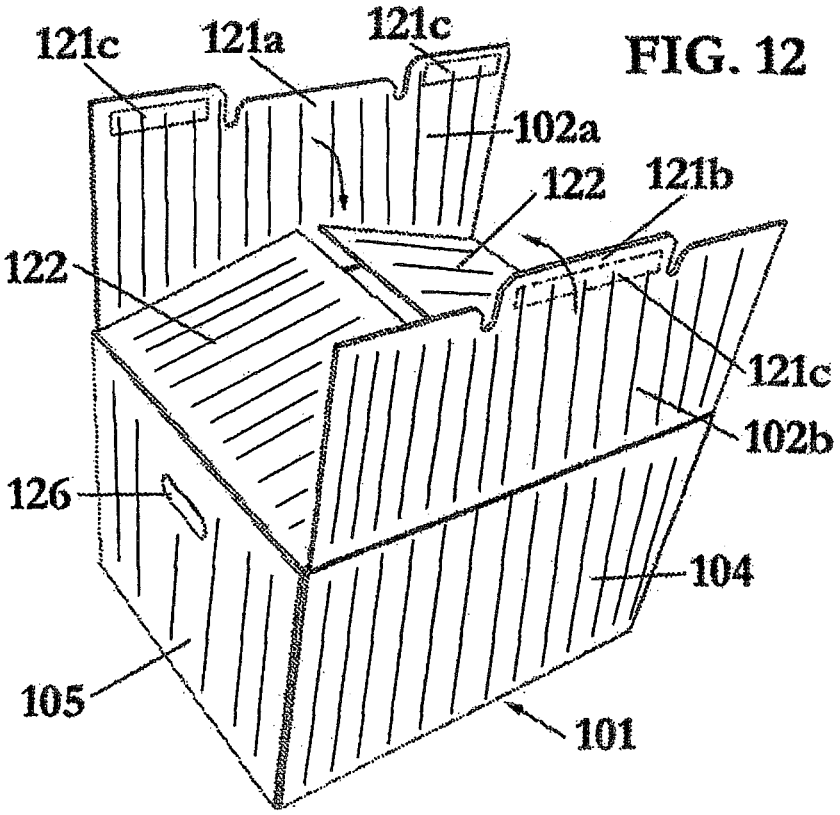
FIG. 12 is a top perspective view of the storage box of the present invention, according to said second embodiment.

A second embodiment of the storage box of the present invention is shown in FIGS. 11 and 12. The main difference between this second embodiment with respect to the first embodiment previously described in its lid, that is formed by two hinged sectors 102*a* and 102*b* and complementary to each other. These sectors 102*a*, 102*b* comprise complementary flaps 121*a*, 121*b* that permit to close the lid without any addition closing elements, such as e.g. without adhesive tape.

The lid also comprises additional flaps 122 that are folded below the sectors 102*a*, 102*b*. It is illustrated in FIG. 12, that the complimentary flap 121*a* is disposed between two side regions, so as to extend inwardly to form a recess. The complimentary flap 121*b* is positioned between two side regions, extending outwardly therefrom to form a projection. It is also shown in FIG. 12, that the complimentary flap 121*b* is formed with a pair of spaced grooves extended from a level of the side regions. It is also illustrated in FIGS. 11 and 12 that the box is made from a corrugated material. The channels of the corrugated cardboard are oriented in the vertical direction on the side faces if the box.

In FIG. 11 it can be seen how the sectors 101*a*, 101*b*, 101*c*, 101*d* that form the opposed face of the lid, in this case the bottom 101, are placed.

Furthermore, two opposed faces 105, 106 comprise handle-like holes 126 to facilitate the manual handling of the box.

In FIG. 12 it can be seen that the lid also comprises adhesives 121*c*, preferably double-faced adhesive tape, that reinforce the closing of the lid and prevent any accidental aperture of the lid.

Figure 13:
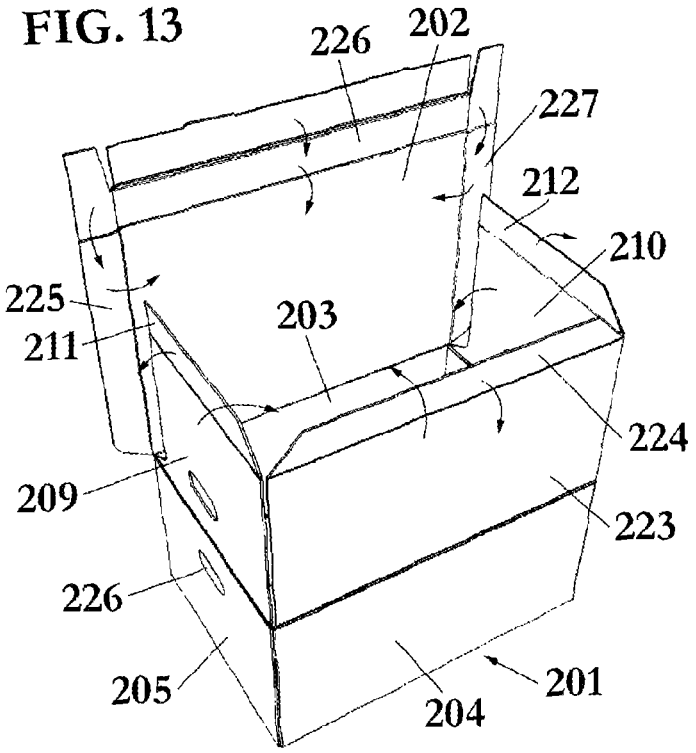
FIG. 13 is a perspective view of the storage box of the present invention partially unfolded, according to a third embodiment.
Figure 14:
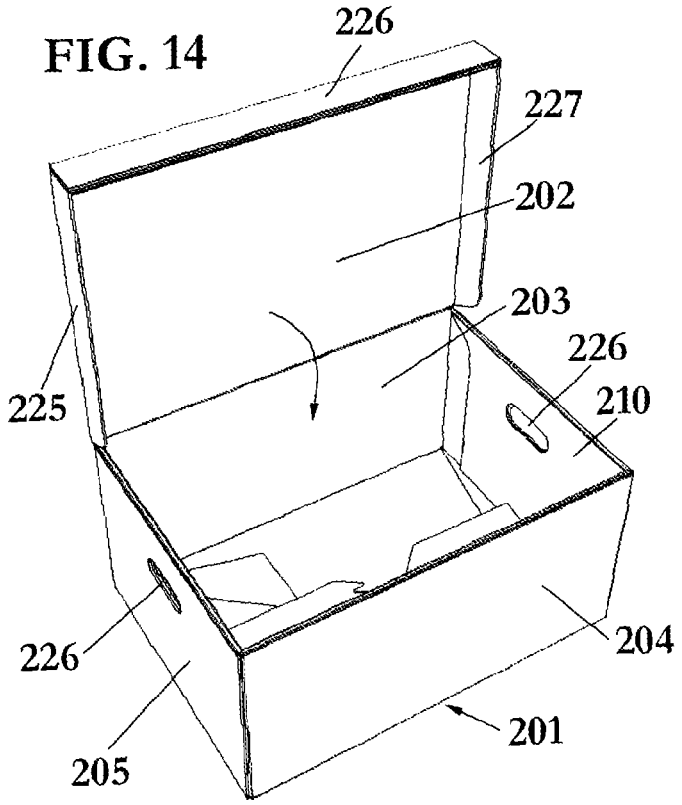
FIG. 14 is a perspective view of the storage box of the present invention with the lid opened, according to a third embodiment.

In FIG. 13 it is shown a third embodiment of the storage box of the present invention.

In this case, the opposed face (or bottom) 201 with respect to the lid is exactly the same to those described regarding the first and second embodiments.

In this embodiment the lid comprises several reinforcing flaps 225, 226, 227 placed around it. One of these flaps 226 is double, such as it is shown in FIG. 13.

The box according to this embodiment also comprises three reinforcing sectors 209, 210, 223 equivalent to the reinforcing sectors described in the first embodiment. These reinforcing sectors 209, 210, 223 are folded on the respective faces, and comprise flaps 211, 212, 224, that in the mounting position is placed on the bottom 201.

Even though reference is made to a specific embodiment of the invention, it is apparent for a person skilled in the art that the storage box described is susceptible of numerous variations and modifications, and that all the details cited can be substituted by other technically equivalent ones, without departing from the scope of protection defined by the attached claims.

What is claimed is:

1. A storage box formed from a sheet of material, said box comprising:

a rear face, a front face, an upper face, a lower face and two side faces;

said rear face comprises a first sector provided with a first oblique folding line defining a first joining zone, a second sector provided with a second oblique folding line joined to said first sector at said first joining zone, a third sector formed with a third oblique folding line defining a second joining zone, and a fourth sector joined to said third sector at said second joining zone;

a first lid sector and a second lid sector hingedly connected to one of the upper face and the lower face;

each said lid sector is formed with a complimentary flap, a flap of the first lid sector is formed with a central region disposed between two side regions, the central region of the first sector extends inwardly from a level of said side regions to form a recess, a flap of the second lid sector is formed with a central region disposed between two side regions, the central region of the second sector extends outwardly from a level of the side regions to form a projection;

the flap of the first lid sector formed with a pair of spaced from each other engaging grooves, said engaging grooves extending inwardly from the recess;

the flap of the second lid sector formed with a pair of spaced from each other engaging grooves extending inwardly from the side regions; and said side regions of the first lid sector are provided with adhesive;

wherein in a closed condition of the storage box said projection of the second lid sector is received within said recess of the first lid sector, and the engaging grooves of the first lid sector engage the engaging grooves of the second lid sector.

2. The storage box according to claim 1, wherein the first sector has a trapezoidal shape, said first oblique folding line of the first sector defines two triangular zones.

3. The storage box according to claim 1, wherein the second sector has a substantially rectangular shape, said second oblique folding line of the second sector defines a triangular zone and a trapezoidal zone.

4. The storage box according to claim 1, wherein the third sector has a trapezoidal shape, said third oblique folding line of the third sector defines two triangular zones.

5. The storage box according to claim 1, wherein the fourth sector has a trapezoidal shape.

6. The storage box according to claim 1, wherein said box is made from a single sheet of corrugated cardboard having channels, wherein the channels are oriented in a vertical direction when the storage box is in its use position.

7. The storage box according to claim 1, wherein said adhesive is adjacent to the respective engaging grooves, so as to reinforce closing of the lid and prevent accidental box opening.

8. The storage box according to claim 1, wherein said projection of the second sector is provided with adhesive, so as to reinforce the lid closing and prevent accidental opening of the box.

9. The storage box according to claim 1, further comprising additional flaps, in a closed position of the storage box said additional flaps are positioned below said first and second lid sectors.

10. The storage box according to claim 9, wherein in said sheet material said additional flaps and said first and second lid sectors extend from the respective side faces, the upper and lower faces in same direction.

11. A reusable storage box, said box comprising:

a storage box formed from a single sheet of a corrugated cardboard provided with a plurality of reinforcing channels extending through said single sheet in one direction;

a rear face, a front face, an upper face, a lower face and two side faces;

said rear face comprises a first sector provided with an oblique folding line defining a first joining zone, a second sector provided with an oblique folding line joined to said first sector at said first joining zone, a third sector formed with an oblique folding line defining a second joining zone, and a fourth sector joined to said third sector at said second joining zone;

a first lid sector and a second lid sector hingedly connected to one of the upper face and the lower face along first and second folding lines;

each said lid sector is formed with a complimentary flap, a flap of the first lid sector is formed with a central region disposed between two side regions, the central region of the first sector extends inwardly from a level of said side regions to form a recess, a flap of the second lid sector is formed with a central region disposed between two side regions, the central region of the second sector extends outwardly from a level of the side regions to form a projection;

the flap of the first lid sector formed with a pair of spaced from each other engaging grooves, said engaging grooves extending inwardly from the recess;

the flap of the second lid sector formed with a pair of spaced from each other engaging grooves extending inwardly from the side regions; so that in a closed condition of the reusable storage box said projection of the second lid sector is received within said recess of the first lid sector, and the engaging grooves of the first lid sector engage the engaging grooves of the second lid sector; and a reinforced area developed at a central part of the lid in said closed condition of the box by the flaps of the first and second lid sectors overlapping each other, so as to form a double layer zone by said single sheet of the corrugated cardboard at said central part of the lid, said reinforced area being further fortified by the plurality of the reinforcing channels provided in said first and second lid sectors oriented substantially perpendicular to the first and second folding lines.

12. The storage box according to claim 11, wherein at least two of said faces comprise reinforcing sectors that are folded on the respective faces.

13. The storage box according to claim 12, wherein three of said faces comprise reinforcing sectors that are folded on the respective faces.

14. The storage box according to claim 12, wherein the reinforcing sectors comprise flaps, that in the mounting position of the box are in contact with the face opposed to the lid.

15. The storage box according to claim 11, wherein one of said faces comprises a joining flap that, in the mounting position of the box, is joined to the upper part of the adjacent face.

16. The storage box according to claim 11, wherein the storage box further comprises reinforcing flaps around the lid.

* * * * *